US007347729B2

(12) United States Patent
Thomas et al.

(10) Patent No.: US 7,347,729 B2
(45) Date of Patent: Mar. 25, 2008

(54) PREPLESS COAXIAL CABLE CONNECTOR

(75) Inventors: Charles E. Thomas, Athens, PA (US); Brian T. Thayer, Bridgeport, NY (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/581,127

(22) Filed: Oct. 13, 2006

(65) Prior Publication Data

US 2007/0093127 A1 Apr. 26, 2007

Related U.S. Application Data

(60) Provisional application No. 60/728,494, filed on Oct. 20, 2005.

(51) Int. Cl.
*H01R 9/05* (2006.01)

(52) U.S. Cl. ..... 439/583

(58) Field of Classification Search ..... 439/578, 439/583–585

See application file for complete search history.

(56) References Cited

U.S. PATENT DOCUMENTS 2,258,737 A 10/1941 Browne
2,549,647 A 4/1951 Turenne
3,184,706 A * 5/1965 Atkins ..... 439/584
3,292,136 A 12/1966 Somerset
3,373,243 A 3/1968 Janowiak et al.
3,406,373 A 10/1968 Forney, Jr.
3,448,430 A 6/1969 Kelly
3,475,545 A 10/1969 Stark et al.
3,498,647 A 3/1970 Schoder
3,517,373 A 6/1970 Jamon
3,533,051 A 10/1970 Ziegler, Jr.
3,537,065 A 10/1970 Winston
3,668,612 A 6/1972 Nepovim
3,671,922 A 6/1972 Zerlin et al.
3,710,005 A 1/1973 French
3,778,535 A 12/1973 Fomey, Jr.
3,781,762 A 12/1973 Quackenbush (Continued)

FOREIGN PATENT DOCUMENTS

DE 1 515 398 11/1962

(Continued)

OTHER PUBLICATIONS

Sell Sheet from Stirling; www.StirlingUSA.com; Reader Service No. 109; regarding SPL-6-RTQ 3-In-One RTQ Connectors.

(Continued)

*Primary Examiner*—Ross Gushi
(74) *Attorney, Agent, or Firm*—Hoffman & Baron, LLP

(57) ABSTRACT

A coaxial cable connector includes a connector body and an annular post coupled to the connector body. The connector body has a rearward cable receiving end and an internal threaded surface defined in the rearward cable receiving end. The internal threaded surface is adapted to threadably engage an outer surface of a coaxial cable. The annular post has a rearward cable insertion end disposed within the connector body, which preferably defines a sharp edge adapted to penetrate an end of the cable as the connector body is threaded on the outer surface of the cable.

19 Claims, 4 Drawing Sheets

U.S. PATENT DOCUMENTS

| | | | | |
|---|---|---|---|---|
| 3,845,453 | A | | 10/1974 | Hemmer |
| 3,846,738 | A | | 11/1974 | Nepovim |
| 3,854,003 | A | | 12/1974 | Duret |
| 3,879,102 | A | | 4/1975 | Horak |
| 3,907,399 | A | | 9/1975 | Spinner |
| 3,910,673 | A | | 10/1975 | Stokes |
| 3,915,539 | A | | 10/1975 | Collins |
| 3,936,132 | A | | 2/1976 | Hutter |
| 3,963,320 | A | | 6/1976 | Spinner |
| 3,976,352 | A | | 8/1976 | Spinner |
| 3,985,418 | A | | 10/1976 | Spinner |
| 4,046,451 | A | | 9/1977 | Juds et al. |
| 4,053,200 | A | | 10/1977 | Pugner |
| 4,059,330 | A | | 11/1977 | Shirey |
| 4,093,335 | A | | 6/1978 | Schwartz et al. |
| 4,126,372 | A | | 11/1978 | Hashimoto et al. |
| 4,131,332 | A | | 12/1978 | Hogendobler et al. |
| 4,165,554 | A | | 8/1979 | Faget |
| 4,168,921 | A | | 9/1979 | Blanchard |
| 4,227,765 | A | | 10/1980 | Neumann et al. |
| 4,250,348 | A | | 2/1981 | Kitagawa |
| 4,280,749 | A | | 7/1981 | Hemmer |
| 4,339,166 | A | | 7/1982 | Dayton |
| 4,346,958 | A | | 8/1982 | Blanchard |
| 4,354,721 | A | | 10/1982 | Luzzi |
| 4,373,767 | A | | 2/1983 | Cairns |
| 4,400,050 | A | | 8/1983 | Hayward et al. |
| 4,408,821 | A | | 10/1983 | Forney, Jr. |
| 4,408,822 | A | | 10/1983 | Nikitas |
| 4,421,377 | A | | 12/1983 | Spinner |
| 4,444,453 | A | | 4/1984 | Kirby et al. |
| 4,456,323 | A | | 6/1984 | Pitcher et al. |
| 4,515,427 | A | | 5/1985 | Smit |
| 4,540,231 | A | | 9/1985 | Forney, Jr. |
| 4,545,637 | A | | 10/1985 | Bosshard et al. |
| 4,575,274 | A | | 3/1986 | Hayward et al. |
| 4,583,811 | A | | 4/1986 | McMills |
| 4,593,964 | A | | 6/1986 | Forney, Jr. et al. |
| 4,596,434 | A | | 6/1986 | Saba et al. |
| 4,596,435 | A | | 6/1986 | Bickford |
| 4,598,961 | A | | 7/1986 | Cohen |
| 4,600,263 | A | | 7/1986 | DeChamp et al. |
| 4,614,390 | A | | 9/1986 | Baker |
| 4,632,487 | A | | 12/1986 | Wargula |
| 4,655,159 | A | | 4/1987 | McMills |
| 4,660,921 | A | | 4/1987 | Hauver |
| 4,668,043 | A | | 5/1987 | Saba et al. |
| 4,674,818 | A | | 6/1987 | McMills et al. |
| 4,676,577 | A | | 6/1987 | Szegda |
| 4,682,832 | A | | 7/1987 | Punako et al. |
| 4,688,876 | A | | 8/1987 | Morelli |
| 4,688,878 | A | | 8/1987 | Cohen et al. |
| 4,703,987 | A | | 11/1987 | Gallusser et al. |
| 4,717,355 | A | | 1/1988 | Mattis |
| 4,746,305 | A | | 5/1988 | Nomura |
| 4,747,786 | A | | 5/1988 | Hayashi et al. |
| 4,755,152 | A | | 7/1988 | Elliot et al. |
| 4,761,146 | A | | 8/1988 | Sohoel |
| 4,772,222 | A | | 9/1988 | Laudig et al. |
| 4,789,355 | A | | 12/1988 | Lee |
| 4,806,116 | A | | 2/1989 | Ackerman |
| 4,834,675 | A | | 5/1989 | Samchisen |
| 4,854,893 | A | | 8/1989 | Morris |
| 4,857,014 | A | | 8/1989 | Alf et al. |
| 4,869,679 | A | | 9/1989 | Szegda |
| 4,874,331 | A | | 10/1989 | Iverson |
| 4,892,275 | A | | 1/1990 | Szegda |
| 4,902,246 | A | | 2/1990 | Samchisen |
| 4,906,207 | A | | 3/1990 | Banning et al. |
| 4,923,412 | A | | 5/1990 | Morris |
| 4,925,403 | A | | 5/1990 | Zorzy |
| 4,927,385 | A | | 5/1990 | Cheng |
| 4,929,188 | A | | 5/1990 | Lionetto et al. |
| 4,952,174 | A | | 8/1990 | Sucht et al. |
| 4,957,456 | A | | 9/1990 | Olson et al. |
| 4,973,265 | A | | 11/1990 | Heeren |
| 4,979,911 | A | | 12/1990 | Spencer |
| 4,990,104 | A | | 2/1991 | Schieferly |
| 4,990,105 | A | | 2/1991 | Karlovich |
| 4,990,106 | A | | 2/1991 | Szegda |
| 5,002,503 | A | | 3/1991 | Campbell et al. |
| 5,007,861 | A | | 4/1991 | Stirling |
| 5,021,010 | A | | 6/1991 | Wright |
| 5,024,606 | A | | 6/1991 | Ming-Hwa |
| 5,037,328 | A | | 8/1991 | Karlovich |
| 5,066,248 | A | | 11/1991 | Gaver, Jr. et al. |
| 5,073,129 | A | | 12/1991 | Szegda |
| 5,083,943 | A | | 1/1992 | Tarrant |
| 5,120,260 | A | | 6/1992 | Jackson |
| 5,127,853 | A | | 7/1992 | McMills et al. |
| 5,131,862 | A | | 7/1992 | Gershfeld |
| 5,141,451 | A | | 8/1992 | Down |
| 5,154,636 | A | * | 10/1992 | Vaccaro et al. ..... 439/583 |
| 5,161,993 | A | | 11/1992 | Leibfried, Jr. |
| 5,195,906 | A | | 3/1993 | Szegda |
| 5,207,602 | A | | 5/1993 | McMills et al. |
| 5,217,391 | A | | 6/1993 | Fisher, Jr. |
| 5,217,393 | A | | 6/1993 | Del Negro et al. |
| 5,269,701 | A | | 12/1993 | Leibfried, Jr. |
| 5,283,853 | A | | 2/1994 | Szegda |
| 5,284,449 | A | | 2/1994 | Vaccaro |
| 5,295,864 | A | | 3/1994 | Birch et al. |
| 5,316,494 | A | | 5/1994 | Flanagan et al. |
| 5,338,225 | A | | 8/1994 | Jacobsen et al. |
| 5,342,218 | A | | 8/1994 | McMills et al. |
| 5,354,217 | A | | 10/1994 | Gabel et al. |
| 5,371,819 | A | | 12/1994 | Szegda |
| 5,371,821 | A | | 12/1994 | Szegda |
| 5,371,827 | A | | 12/1994 | Szegda |
| 5,393,244 | A | * | 2/1995 | Szegda ..... 439/394 |
| 5,431,583 | A | | 7/1995 | Szegda |
| 5,435,745 | A | | 7/1995 | Booth |
| 5,444,810 | A | | 8/1995 | Szegda |
| 5,455,548 | A | | 10/1995 | Grandchamp et al. |
| 5,456,611 | A | | 10/1995 | Henry et al. |
| 5,456,614 | A | | 10/1995 | Szegda |
| 5,466,173 | A | | 11/1995 | Down |
| 5,470,257 | A | | 11/1995 | Szegda |
| 5,494,454 | A | | 2/1996 | Johnsen |
| 5,501,616 | A | | 3/1996 | Holliday |
| 5,525,076 | A | | 6/1996 | Down |
| 5,542,861 | A | | 8/1996 | Anhalt et al. |
| 5,548,088 | A | | 8/1996 | Gray et al. |
| 5,571,028 | A | | 11/1996 | Szegda |
| 5,586,910 | A | | 12/1996 | Del Negro et al. |
| 5,598,132 | A | | 1/1997 | Stabile |
| 5,607,325 | A | | 3/1997 | Toma |
| 5,620,339 | A | | 4/1997 | Gray et al. |
| 5,632,651 | A | | 5/1997 | Szegda |
| 5,651,699 | A | | 7/1997 | Holliday |
| 5,667,405 | A | | 9/1997 | Holliday |
| 5,863,220 | A | | 1/1999 | Holliday |
| 5,879,191 | A | | 3/1999 | Burris |
| 5,934,937 | A | | 8/1999 | McCarthy |
| 5,967,852 | A | | 10/1999 | Follingstad et al. |
| 5,975,951 | A | | 11/1999 | Burris et al. |
| 5,997,350 | A | | 12/1999 | Burris et al. |
| 6,032,358 | A | | 3/2000 | Wild |
| 6,089,912 | A | | 7/2000 | Tallis |
| 6,089,913 | A | * | 7/2000 | Holliday ..... 439/584 |
| 6,146,197 | A | | 11/2000 | Holliday et al. |
| 6,217,383 | B1 | | 4/2001 | Holland |
| 6,241,553 | B1 | | 6/2001 | Hsia |
| 6,261,126 | B1 | | 7/2001 | Stirling |

| | | | | |
|---|---|---|---|---|
| 6,352,448 | B1 * | 3/2002 | Holliday et al. | 439/585 |
| 6,425,782 | B1 | 7/2002 | Holland | |
| 6,530,807 | B2 | 3/2003 | Rodrigues et al. | |
| 6,558,194 | B2 | 5/2003 | Montena | |
| 6,805,584 | B1 | 10/2004 | Chen | |
| 6,817,896 | B2 | 11/2004 | Derenthal | |
| 6,848,940 | B2 | 2/2005 | Montena | |
| 6,971,912 | B2 * | 12/2005 | Montena et al. | 439/578 |
| 7,018,235 | B1 * | 3/2006 | Burris et al. | 439/584 |
| 2004/0102089 | A1 | 5/2004 | Chee | |
| 2004/0229504 | A1 | 11/2004 | Liu | |
| 2005/0079761 | A1 * | 4/2005 | Rodrigues | 439/578 |

FOREIGN PATENT DOCUMENTS

| | | | |
|---|---|---|---|
| DE | 1 191 880 | | 4/1965 |
| DE | 2 221 936 | | 5/1972 |
| DE | 2 261 973 | | 12/1972 |
| DE | 32 11 008 | A1 | 10/1983 |
| EP | 0 116 157 | A1 | 8/1984 |
| EP | 0 167 738 | A2 | 1/1986 |
| EP | 0 265 276 | B1 | 4/1988 |
| FR | 2 462 798 | | 2/1981 |
| GB | 1087228 | | 10/1967 |
| GB | 1 270 846 | | 4/1972 |
| GB | 2019 665 | A | 10/1979 |
| GB | 2 079 549 | A | 1/1982 |
| GB | 2079 549 | A | 1/1982 |
| WO | WO 93/24973 | | 12/1993 |
| WO | WO 96/08854 | | 3/1996 |

OTHER PUBLICATIONS

Sell Sheet from PCT International; Reader Service No. 133; regarding DRS Compression Connectors—description/features and benefits.

* cited by examiner

PREPLESS COAXIAL CABLE CONNECTOR

CROSS-REFERENCE TO RELATED APPLICATIONS

This application claims the benefit of U.S. Provisional Application No. 60/728,494, filed on Oct. 20, 2005.

FIELD OF THE INVENTION

The present invention relates generally to connectors for terminating coaxial cable. More particularly, the present invention relates to a coaxial cable connector providing an attachment method which eliminates the need to prepare the end of a coaxial cable.

BACKGROUND OF THE INVENTION

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator. Upon assembly to a coaxial cable, the annular post is inserted between the foil covered insulator and the conductive shield of the cable.

Needless to say, the process of preparing an end of a coaxial cable for installation into a connector requires a modicum of skill and is somewhat time consuming. A further problem with current coaxial connectors is that in order to properly attach the connector to the coaxial shielded cable, a good deal of manual force must be applied to push the coaxial shielded cable over the barbs of the post. During conventional installation, the cable can buckle when the post with the barb is pushed between the foil and the braid and create an unsatisfactory electrical and mechanical connection. Thus, a mistake made in the preparation process may result in a faulty connector installation.

It is, therefore, desirable to provide a coaxial connector which eliminates the need to prepare an end of a coaxial cable. In particular, it would be desirable to provide a coaxial connector that allows a cable that has simply been cleanly cut square to be installed therein. It would be further desirable to provide a coaxial cable connector that eliminates the need to use excessive force to push the post into the coaxial shielded cable and prevents buckling of the coaxial shielded cable.

OBJECTS AND SUMMARY OF THE INVENTION

It is an object of the present invention to provide a coaxial cable connector for terminating a coaxial cable.

It is a further object of the present invention to provide a coaxial cable connector which eliminates the need to prepare an end of a coaxial cable.

In the efficient attainment of these and other objects, the present invention provides a coaxial cable connector. The connector of the present invention generally includes a connector body and an annular post coupled to the connector body. The connector body has a rearward cable receiving end and an internal threaded surface defined in the rearward cable receiving end. The internal threaded surface is adapted to threadably engage an outer surface of a coaxial cable. The annular post has a rearward cable insertion end disposed within the connector body, which preferably defines a sharp edge adapted to penetrate an end of the cable as the connector body is threaded on the outer surface of the cable.

In a preferred embodiment, the connector further includes an axially movable locking sleeve coupled to the rearward cable receiving end of the connector body for locking the cable in the connector. The connector further preferably includes an annular compression gasket disposed between the locking sleeve and the connector body, which expands in a radially inward direction upon compression between the locking sleeve and the connector body to grip the outer surface of the cable. The locking sleeve preferably includes an outer threaded surface and the connector body further includes an internal threaded sleeve engagement surface cooperating with the sleeve outer threaded surface to facilitate axial movement of the locking sleeve in the connector body.

The connector of the present invention may further include an annular post having a terminal pin centrally disposed therein. The terminal pin includes a rearward end having a central bore formed thereon for receiving a center conductor of the coaxial connector. The rearward end of the pin preferably terminates at a sharp edge to facilitate penetration of the pin between the center conductor and a surrounding insulator portion of the coaxial cable.

The present invention further involves a method for terminating a coaxial cable in a connector. The method generally includes the steps of cutting an end of a coaxial cable square, or in a manner which permits a length of a center conductor of the cable to extend a distance outwardly therefrom, and rotating a connector body of the connector on the end of the cable so that an internal threaded surface of the connector body threadably engages an outer surface of the jacket. Rotation of the connector body on the cable also causes an annular post disposed within the connector body to penetrate the end of the cable.

A preferred embodiment of the method further includes the step of axially moving a locking sleeve into the connector body to lock the cable in the connector, wherein the axial movement of the locking sleeve compresses a compression gasket, whereby the compression gasket expands radially inward to grip the cable.

As a result of the present invention, the time required to prepare the end of a coaxial cable prior to installation on the connector is drastically minimized if not entirely eliminated.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
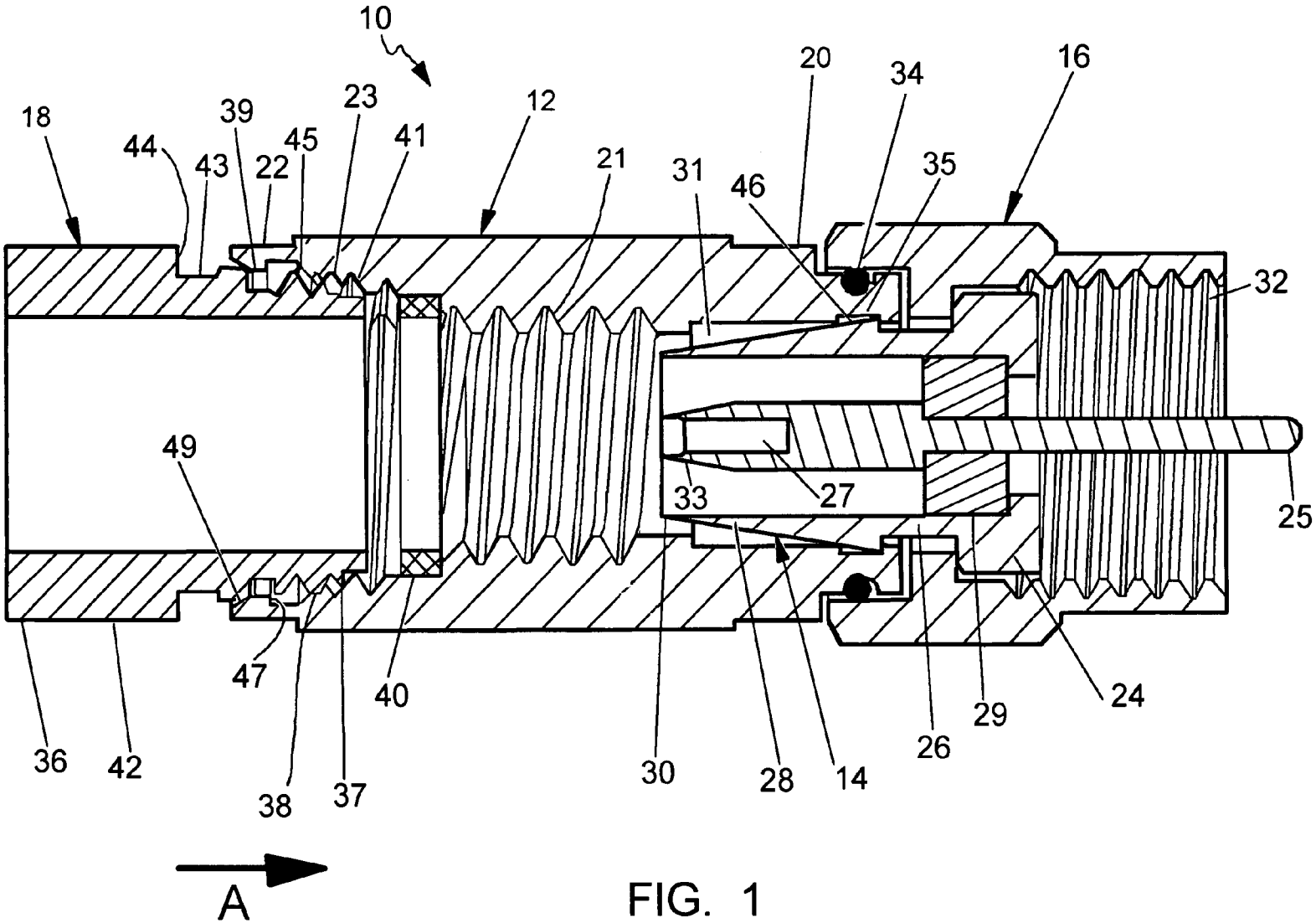
FIG. 1 is a cross-sectional view of the coaxial cable connector of the present invention in an open position.
Figure 2:
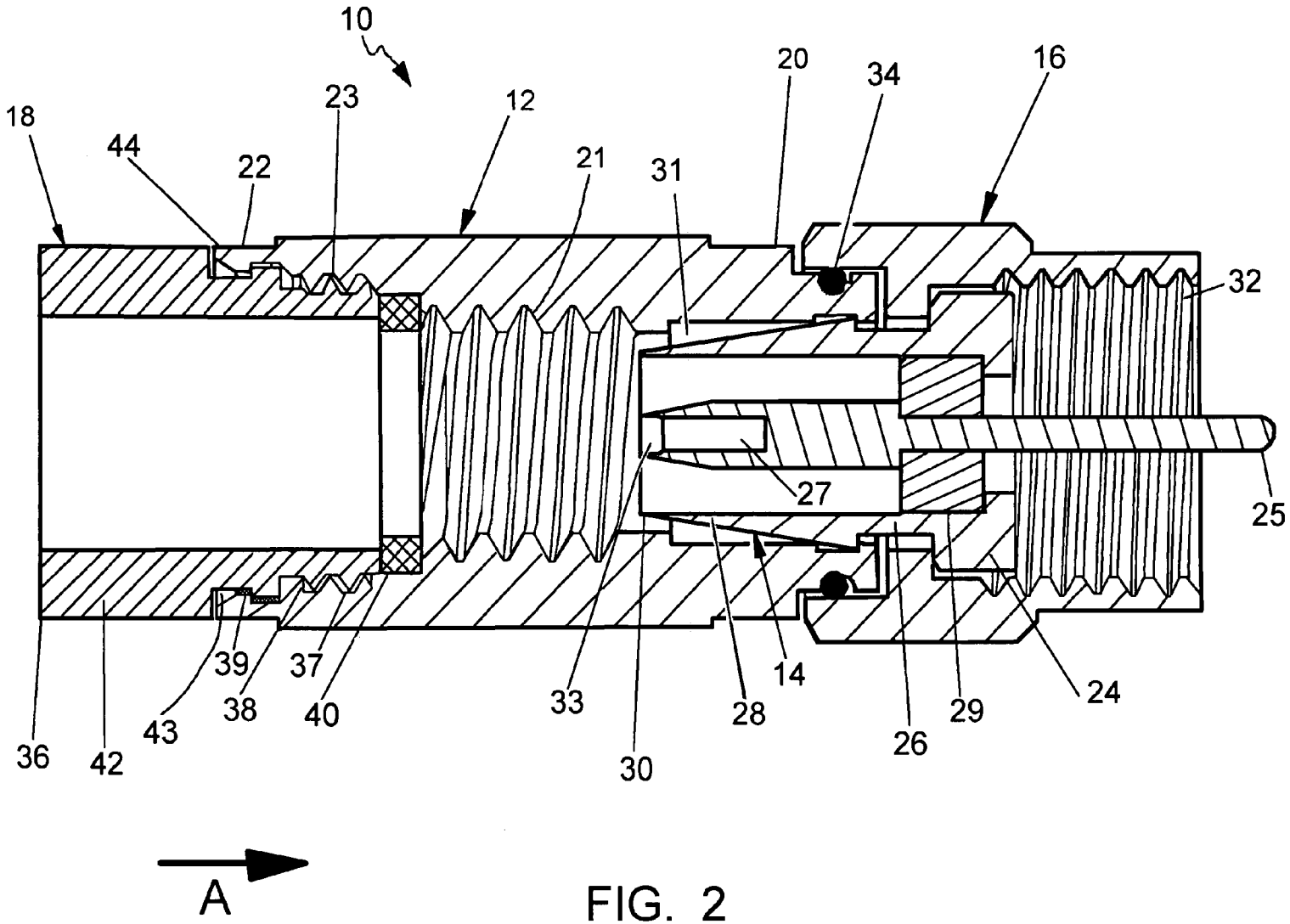
FIG. 2 is a cross-sectional view of the connector shown in FIG. 1 in a closed position.

Referring first to FIGS. 1 and 2, the coaxial cable connector 10 of the present invention is shown. The connector 10 generally includes three components: a connector body 12; an annular post 14; and a rotatable nut 16. The connector 10 further preferably includes an axially movable locking sleeve 18 to help secure the cable to the connector, as will be discussed in further detail below. It is also conceivable that the connector body 12 and the post 14 can be integrated into one component and/or another fastening device other than the rotatable nut 16 can be utilized.

The connector body 12 is an elongate generally cylindrical member, which is preferably made from plastic to minimize cost. Alternatively, the body 12 may be made from metal or the like. The body 12 has a forward end 20 coupled to the post 14 and the nut 16 and an opposite rearward cable receiving end 22 for insertably receiving the end of a coaxial cable. In this regard, the forward end 20 of the connector body 12 preferably includes an internal groove or recess 35 for receiving a widened portion 46 of the post 14 in snap-fit engagement. The widened portion 46 of the post may simply be the forward termination of the of the post's ramped flange portion 28, as shown in the drawings, or a dedicated protrusion can be formed on the post 14 for seating within the groove 35. In either case, the widened portion 46 and the groove 35 include opposite locking surfaces which, once engaged, prevent forward axial movement of the post 14 with respect to the connector body 12.

The annular post 14 further includes a flanged base portion 24, which provides for securement of the nut 16 to the connector body 12. In particular, the nut 16 is formed with a post receiving groove or space 48 for receiving the flanged base portion 24 of the post 14. Upon assembly, the post 14 is first slipped into the nut 16 so that the flanged base portion 24 is received within the post receiving space 48 of the nut. The rearward end of the post 14, with the nut 16 thus retained and its forward end, is then inserted into the forward end 20 of the connector body 12 until the post widened portion or protrusion 46 is snap-fit into the internal groove 35 of the connector body. In this manner, the post 14 and the nut 16 are retained to the connector body 12.

The nut 16 may be in any form, such as a hex nut, knurled nut, wing nut, or any other known attaching means, and is rotatably coupled to the post 14 for providing mechanical attachment of the connector 10 to an external device. The nut 16 includes an internally threaded end extent 32 permitting screw threaded attachment of the connector 10 to the external device. A resilient sealing O-ring 34 may be positioned between the body 12 and the nut 16 at the rotatable juncture thereof to provide a water resistant seal thereat.

The opposite rearward cable receiving end 22 defines an internally threaded cable engagement surface 21 for threadably engaging the outer jacket of the cable, as will be described in further detail below. The internal thread of the cable engagement surface 21 has a diameter slightly smaller than the outside diameter of the cable for which the connector 10 is adapted to secure.

Also, at its rearward most end, the cable receiving end 22 of the connector body 12 further preferably defines an inner sleeve engagement surface 23 for engaging the locking sleeve 18, as will be described in further detail below. The inner sleeve engagement surface 23 may be adapted to simply frictionally engage and secure the sleeve 18, or it may be provided with structure, such as detents, grooves or protrusions, which cooperate with corresponding structure provided on the sleeve 18. Such structure is described in commonly owned U.S. Pat. No. 6,530,807, the specification of which is incorporated herein by reference.

However, in the preferred embodiment, the inner sleeve engagement surface 23 is defined by a combination of a rearward raised protrusion 39 and an internal threaded surface 41. The rearward raised protrusion 39 of the connector body 12 extends axially inwardly and is received in a groove 43 formed in the locking sleeve 18 when the locking sleeve is in a forward locked position, as will be described in further detail below. At the same time, the internal threaded surface 41 of the connector body sleeve engagement surface 23 mates with an external threaded surface 45 formed on the locking sleeve 18. The internal thread 41 of the sleeve engagement surface 23 has a diameter larger than the diameter of the thread of the cable engagement surface 21 to permit cable insertion past the inner sleeve engagement surface into the internal threads of the cable engagement surface.

Returning to the annular post 14, the post further includes an annular tubular extension 26 extending within the body 12. The distal end of the tubular extension 26 preferably includes a ramped flange portion 28 which extends radially outwardly in the forward direction for compressing the outer jacket of the coaxial cable against the internal diameter of the body to secure the cable within the connector. The ramped flange portion 28 preferably terminates at the rearward distal end of the post 14 in a sharp edge 30, which facilitates separation of the metallic foil from the metallic shield of the cable during installation, as will be discussed in further detail below. The ramped flange portion 28 of the post 14 and the body 12 define an annular chamber 31 for accommodating the jacket and shield of the inserted coaxial cable.

The present invention is particularly suited for coaxial connectors having an integral terminal pin, although use in other types of connectors is fully contemplated. In integral pin-type connectors, the post 14 further includes an internal pin 25 centrally disposed therein and having a central bore 27 formed in a rearward distal end thereof for receiving the central conductor of a cable. Preferably, the pin 25 terminates at the rearward distal end in a sharp edge 33 surrounding the central bore 27. The sharp rearward edge 33 of the pin 25 facilitates separation of the central conductor from the core insulator of the cable, as will be discussed in further detail below The post 14 further includes an annular insulator 29 fixed within the post to support the pin 25 in an axially central orientation within the post.

The locking sleeve 18 and the internally threaded end extension 32 of the nut 16 define opposite ends of the connector 10. The locking sleeve 18 is a generally tubular member having a rearward cable receiving end 36 and an opposite forward connector insertion end 38, which is movably coupled to the inner surface 23 of the connector body 12. As mentioned above, the forward end 38 of the sleeve 18 includes an outer cylindrical connector body engagement surface 37, which engages the inner sleeve engagement surface 23 formed in the rearward end 22 of the connector body 12. As also mentioned above, the outer engagement surface 37 of the sleeve may include structure which cooperates with structure formed on the inner engagement surface 23 of the body 12. In the preferred embodiment, the outer engagement surface 37 of the sleeve 18 is defined by a groove 43 and an external thread 45 which respectively cooperate with the raised protrusion 39 and the internal thread 41 formed in the inner engagement surface 23 of the body 12.

In this embodiment, the locking sleeve 18 may be termed a locking nut or a compression nut, since rotation of the sleeve will cause it to move axially inward into the connector body 12 in the forward direction, designated by arrow A. Thus, the locking sleeve 18 is movable towards nut 16 from a first "open" position shown in FIG. 1 to a more forward second "closed" position shown in FIG. 2, which further secures the cable within the connector. The locking sleeve 18 is moved forward into the connector body 12 by rotation of the sleeve until the raised protrusion 39 of the connector body comes to rest within the groove 43 formed in the sleeve. To facilitate this forward movement, and inhibit rearward movement, the raised protrusion 39 of the connector body 12 may include a forwardly facing perpendicular wall 47 and a rearwardly facing chamfered wall 49.

The locking sleeve 18 further preferably includes a flanged head portion 42 disposed adjacent the groove 43 at the rearward cable receiving end 36 thereof. The head portion 42 has an outer diameter larger than the diameter of the inner sleeve engagement surface 23 of the body 12 and includes a forward facing perpendicular wall 44, which serves as an abutment surface against which the rearward end 22 of the body stops to prevent further insertion of the sleeve 18 into the body.

To further enhance gripping of the cable, the connector 10 of the present invention further preferably includes an annular compression gasket 40 disposed between the forward end 38 of the locking sleeve 18 and the connector body 12. Specifically, the compression gasket 40 is preferably positioned within the rearward end 22 of the connector body 12 between the cable engagement surface 21 and the sleeve engagement surface 23. The compression gasket 40 is designed to expand radially inward when compressed by the locking sleeve 18 in the axial direction along arrow A. This radially inward expansion of the compression gasket 40 will cause the gasket to engage the outer surface of a cable inserted within the connector to further secure the cable to the connector. Secondly, the gasket 40 provides a redundant sealing point to prevent the ingress of water or other contaminants into the connector assembly 10. In this regard, the compression gasket 40 is preferably made from a resilient O-ring type material, such as a rubber elastomer, or the like.

The connector 10 of the present invention may be supplied in the assembled condition shown in FIG. 1, wherein the sleeve 18 and the compression gasket 40 are assembled with the body 12 to receive a coaxial cable. In such assembled condition, and as will be described in further detail hereinbelow, a coaxial cable may be inserted through the rearward cable receiving end 36 of the sleeve 18. Also in the assembled condition, the locking sleeve 18 and the compression gasket 40 may be detached from the connector body 12 and reattached as needed.

It is also contemplated that the sleeve 18 may be provided separately from the rest of the connector 10, wherein the sleeve will be slipped over the end of the coaxial cable and the coaxial cable will be inserted directly into the cable receiving end 22 of the connector body 12 unobstructed by the sleeve 18. Thereafter, the sleeve 18 may be attached to the connector body 12 where it can be moved from the first position to the second position locking the cable within the connector.

Having described the components of the connector 10 in detail, the use of the connector in terminating a coaxial cable may now be described with reference to FIG. 3. Coaxial cable 60 includes an inner conductor 62 formed of copper or similar conductive material. Extending around the inner conductor 62 is an insulator 64 formed of a suitably insulative plastic. A metallic foil 66 is disposed over the insulator 64 and a metallic shield 68 is positioned in surrounding relationship around the foil covered insulator. Covering the metallic shield 68 is an outer insulative jacket 70.

The present invention eliminates the need to prepare the end of the cable, particularly where the invention is incorporated in a connector 10 having an integral pin 25. Specifically, instead of having to strip back the jacket 70 to expose an extent of shield 68 and then folding the shield back over the jacket, the present invention merely requires the end of the cable 60 to be cleanly cut square or flush so that all of the components of the cable terminate at the same substantially perpendicular plane. The square end of the cable 60 is then inserted into the connector body 12 so that the cable jacket 70 makes contact with the threaded inner cable engagement surface 21. The cable 60 and the connector body 12 are then oppositely rotated or twisted with respect to each other so that the threads of the cable engagement surface 21 bite into the outer jacket 70 of the cable.

As the connector body 12 is threaded onto the cable 60, the cable is brought further forward into the connector body whereby the sharp edge 30 of the post 14 is driven between the metallic foil 66 and the metallic shield 68 of the cable. Also during this threading motion, the sharp edge 33 of the integral pin 25 is driven between the center conductor 62 and the insulator 64 of the cable 60 so that the center conductor comes to reside in the central bore 27 of the integral pin 25. Threading of the connector body 12 onto the cable 60 continues until the jacket 70 completely fills the annular chamber 31 between the post 14 and the connector body, thereby preventing any further axial movement of the cable with respect to the connector body.

As may be appreciated, the threading motion between the connector body 12 and the cable 60 provides a mechanical advantage in driving the end of the cable into engagement with the post 14. As a result, the force required for installing the cable 60 into the connector 10, along with the associated possibility of buckling the coaxial cable, is greatly reduced as compared with conventional coaxial cable connectors.

Figure 3:
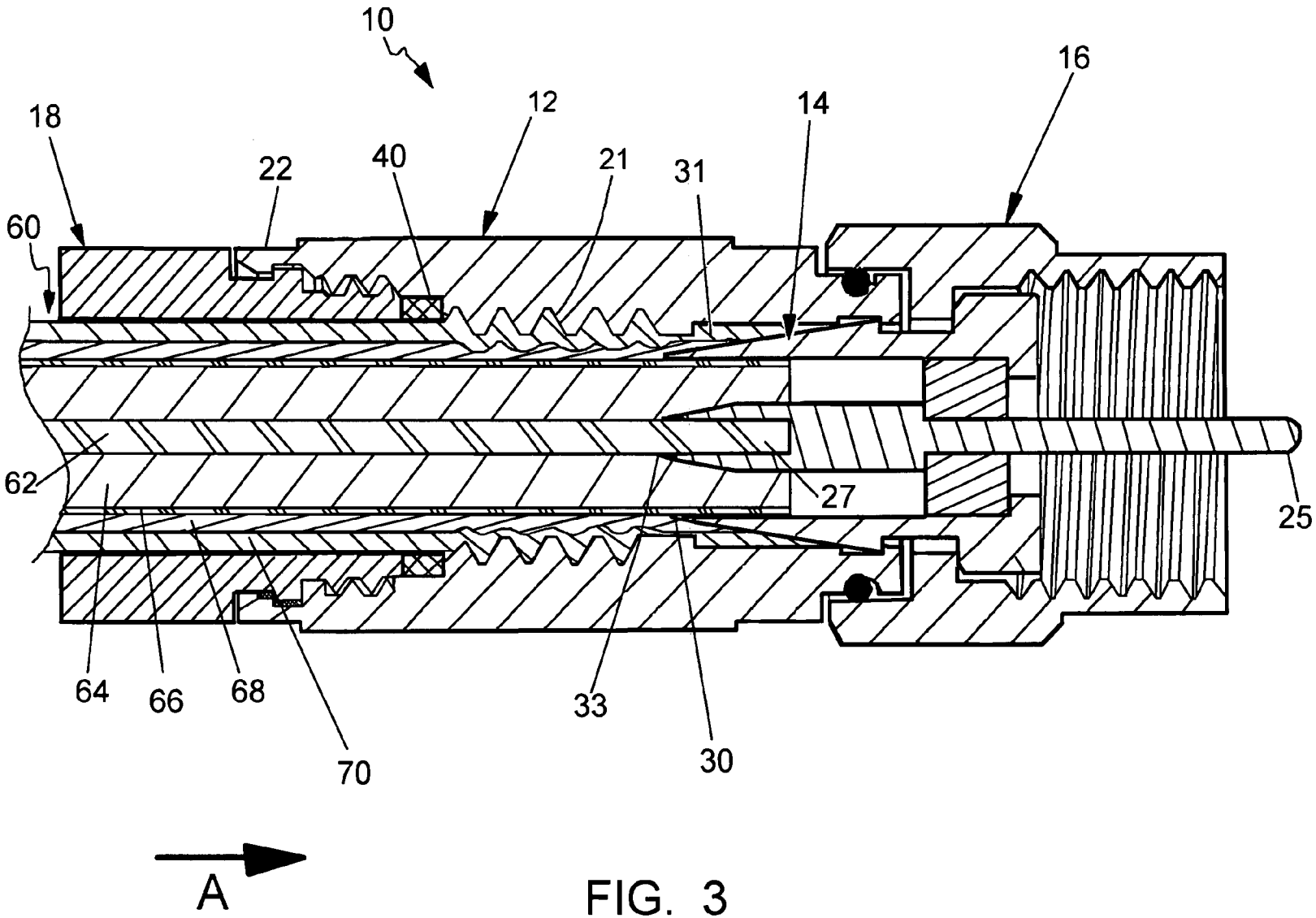
FIG. 3 is a cross-sectional view of the connector shown in FIG. 1 in a closed position with a cable secured thereto.

Once the cable 60 is fully inserted in the connector body 12, the locking sleeve 18 may be inserted into the cable receiving end 22 of the body, if not already in position, and moved axially forward in the direction of arrow A from the first position shown in FIG. 1, to the second position shown in FIGS. 2 and 3. This may be accomplished with a suitable compression tool, or, in the case of the preferred embodiment, by simply threading the sleeve 18 forward.

As the sleeve 18 is moved axially forward, it provides additional compressive force on the outer jacket 70 of the cable to further secure the cable within the connector. As mentioned above, in the preferred embodiment, the locking sleeve 18 works against a compression gasket 40 disposed within the connector body, which expands inwardly to exert a radial compressive force on the cable jacket 70 to further secure the cable 60 within the connector 10.

Figure 4:
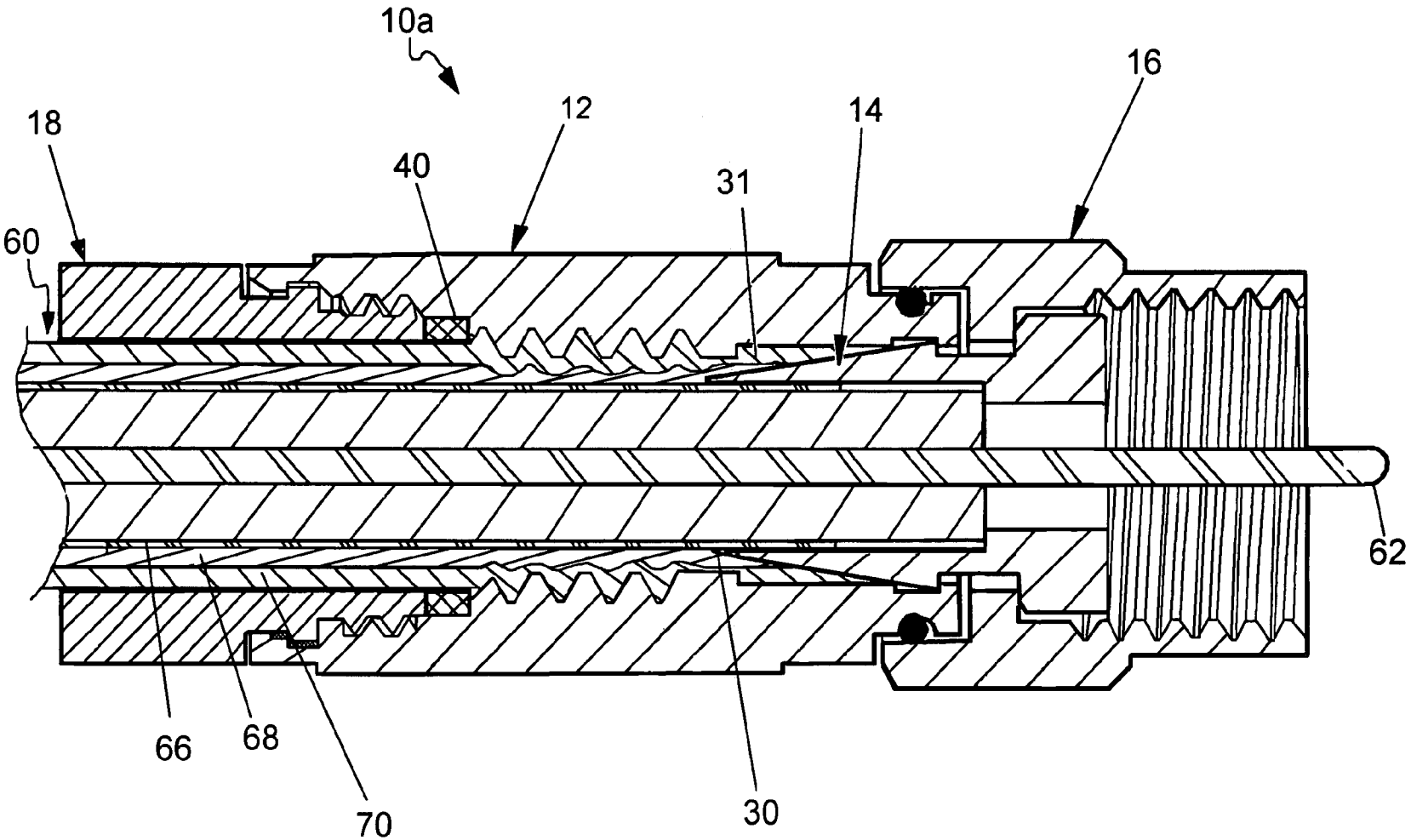
FIG. 4 is a cross-sectional view of an alternative embodiment of the coaxial cable connector of the present invention in a closed position with a cable secured thereto.

As mentioned above, the present invention may also be incorporated in a coaxial cable connector 10*a* which does not utilize an integral pin, as shown in FIG. 4. The coaxial cable connector 10*a* shown in FIG. 4 is identical to the connector 10 shown in FIGS. 1-3 with the exception that the integral pin 25 and the annular insulator 29 have been removed from the post 14. Use of the connector 10*a* shown in FIG. 4 is also the same except for a slight variation in the preparation of the coaxial cable 60. In particular, instead of simply cutting the end of the cable 60 square, as described above with respect to FIGS. 1-3, a suitable length of the cable's center conductor 62 must be allowed to extend beyond the end of the cable in order for the cable to be installed in a connector 10*a* not having an integral pin.

Thus, insertion of a cable 60 into the connector 10*a* of FIG. 4 is the same, wherein the connector body 12 is threaded onto the outer jacket 70 of the cable until the jacket comes to completely reside within the annular chamber 31 formed between the body and the post 14. As the connector body 12 is threaded onto the cable 60, the sharp edge 30 of the post 14 separates the metallic foil 66 from the metallic shield 68 of the cable. Here, however, the center conductor 62 of the cable 60 is not seated within an integral pin, but is extended forward into and beyond the nut 16.

As a result of the present invention, a coaxial cable can be installed in a connector, as shown in FIGS. 1-3, without any preparation other than simply cutting the end of the cable square. The coaxial cable connector in this embodiment requires no preparation of the end of the cable prior to installing the connector. There is a sharp edge on both the post and the terminal pin, which cut into the cable as the connector is threaded onto the cable and make contact with the outer conductor of the cable and the center conductor, respectively.

Alternatively, in a connector as shown in FIG. 4, a coaxial cable can be installed with minimal preparation as compared with conventional coaxial cable connectors. Here, instead of cutting the end of the cable square, a suitable length of the cable's center conductor is left to extend beyond the end of the cable. In this embodiment, there is a sharp edge only on the post, which cuts into the cable as the connector is threaded onto the cable.

In both embodiments, the body of the connector threads over the cable jacket pulling the cable into the connector. Preferably, there is also a compression nut on the back of the connector to be closed after the connector is fully threaded onto the cable. The compression nut, when threaded into the back of the connector, compresses a gasket which seals the cable/connector from water migration at the back of the connector.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a connector body having a rearward cable receiving end, an outer wall and a continuous inner wall defining an opening for receiving a coaxial cable in said rearward cable receiving end, said continuous inner wall including an internally threaded cable engagement portion and a locking sleeve engagement portion, said internally threaded cable engagement portion being adapted to threadably engage an outer surface of the coaxial cable;

an axially movable locking sleeve coupled to said locking sleeve engagement portion of said connector body inner wall, said locking sleeve being movable between a rearward open position and a forward locking position for locking the cable in the connector; and an annular post coupled to said connector body and having a rearward cable insertion end disposed within said connector body, said rearward cable insertion end being adapted to penetrate an end of the cable as said connector body is threaded on the outer surface of the cable.

2. A coaxial cable connector as defined in claim 1, wherein said rearward cable insertion end of said post defines a sharp edge to facilitate penetration into the cable.

3. A coaxial cable connector as defined in claim 1, further comprising an annular compression gasket seated within said connector body between said internally threaded cable engagement portion and said locking sleeve engagement portion of said inner wall, said compression gasket expanding in a radially inward direction upon compression between said locking sleeve and said connector body to grip the outer surface of the cable.

4. A coaxial cable connector as defined in claim 1, wherein said locking sleeve includes an outer threaded surface and said locking sleeve engagement portion of said connector body inner wall is internally threaded for cooperating with said sleeve outer threaded surface to facilitate axial movement of said locking sleeve in said connector body.

5. A coaxial cable connector as defined in claim 1, wherein said locking sleeve and said locking sleeve engagement portion of said inner wall of said connector body include cooperating structure for coupling said locking sleeve to said connector body, said cooperating structure preventing rearward axial movement of said sleeve when said sleeve is in said forward locking position.

6. A coaxial cable connector as defined in claim 5, wherein said cooperating structure comprises a recess formed in one of said connector body and said locking sleeve and a protrusion formed in the other of said connector body and said locking sleeve, said recess and said protrusion including opposite locking surfaces for preventing rearward axial movement of said sleeve when said sleeve is in said forward locking position.

7. A coaxial cable connector as defined in claim 1, wherein said connector body and said annular post include cooperating structure for permitting snap-fit coupling of said post in said connector body, said cooperating structure preventing forward axial movement of said post with respect to said body.

8. A coaxial cable connector as defined in claim 7, wherein said cooperating structure comprises a recess formed in one of said connector body and said post and a protrusion formed in the other of said connector body and said post, said recess and said protrusion including opposite locking surfaces for preventing forward axial movement of said post with respect to said body.

9. A coaxial cable connector as defined in claim 1, wherein said internally threaded cable engagement portion and said locking sleeve engagement portion of said connector body continuous inner wall are axially and radially fixed with respect to each other.

10. A coaxial cable connector as defined in claim 1, wherein said annular post further includes a terminal pin centrally disposed therein, said terminal pin including a rearward end having a central bore formed thereon for receiving a center conductor of the coaxial connector.

11. A coaxial cable connector as defined in claim 10, wherein said rearward end of said pin terminates at a sharp edge to facilitate penetration of said pin between the center conductor and a surrounding insulator portion of the coaxial cable.

12. A method for terminating a coaxial cable in a connector comprising the steps of:

cutting an end of a coaxial cable square, wherein all of the components of the cable terminate on the same plane;

rotating a connector body of the connector on the square end of the cable so that an internal threaded portion formed on a continuous inner wall of the connector body threadably engages an outer surface of the jacket and wherein an annular post disposed within the connector body penetrates the square end of the cable as the connector body is rotated on the cable end; and axially moving a locking sleeve into the connector body to lock the cable in the connector, wherein said locking sleeve engages a locking sleeve engagement portion of said continuous inner wall of said connector body.

13. A method as defined in claim 12, wherein an internal terminal pin of said annular post engages the center conductor of said coaxial cable connector as said post penetrates the square end of said cable.

14. A method as defined in claim 13, further comprising the step of separating the central conductor of the cable from the core insulator of the cable with a sharp rearward edge of said post internal terminal pin as said post penetrates the square end of said cable.

15. A method as defined in claim 12, further comprising the step of compressing a compression gasket with said locking sleeve during said axial movement step, whereby the compression gasket expands radially inward to grip the cable, said compression gasket being seated within said connector body between said internally threaded cable engagement portion and said locking sleeve engagement portion of said inner wall.

16. A method as defined in claim 12, wherein said internally threaded cable engagement portion and said locking sleeve engagement portion of said connector body continuous inner wall remain axially and radially fixed with respect to each other during said step of axially moving said locking sleeve.

17. A method for terminating a coaxial cable in a connector comprising the steps of:

cutting an end of a coaxial cable, whereby a length of a center conductor of the cable is permitted to extend a distance from the end of the cable;

rotating a connector body of the connector on the end of the cable so that an internal threaded cable engagement portion of a continuous inner wall of the connector body threadably engages an outer surface of the jacket and wherein an annular post disposed within the connector body penetrates the end of the cable as the connector body is rotated on the cable end; and axially moving a locking sleeve into the connector body to lock the cable in the connector, wherein the locking sleeve engages a locking sleeve engagement portion of the continuous inner wall of said connector body.

18. A method as defined in claim 17, further comprising the step of compressing a compression gasket with said locking sleeve during said axial movement step, whereby the compression gasket expands radially inward to grip the cable, said compression gasket being seated within said connector body between said internally threaded cable engagement portion and said locking sleeve engagement portion.

19. A method as defined in claim 17, wherein said internally threaded cable engagement portion and said locking sleeve engagement portion of said connector body continuous inner wall remain axially and radially fixed with respect to each other during said step of axially moving said locking sleeve.

* * * * *